United States Patent [19]

Curran

[11] 4,127,955

[45] Dec. 5, 1978

[54] EXTRACTOR ASSEMBLY FOR RIMLESS CARTRIDGES

[75] Inventor: Roger J. Curran, Stratford, Conn.

[73] Assignee: Bangor Punta Operations, Inc., Greenwich, Conn.

[21] Appl. No.: 798,051

[22] Filed: May 18, 1977

[51] Int. Cl.[2] ..... F41C 15/00; F41C 1/00

[52] U.S. Cl. ..... 42/68

[58] Field of Search ..... 42/68, 62, 59

[56] References Cited

U.S. PATENT DOCUMENTS

| | | | |
|---|---|---|---|
| 184,145 | 11/1876 | Cochran | 42/68 |
| 1,181,417 | 5/1916 | Wesson | 42/68 |
| 3,755,950 | 9/1973 | Gunn | 42/68 |
| 3,982,346 | 9/1976 | Pilorget | 42/68 |

*Primary Examiner*—Charles T. Jordan

*Attorney, Agent, or Firm*—Patrick J. Walsh

[57] ABSTRACT

Disclosed is an extractor assembly including an extractor rod splined within a revolver cylinder and carrying spring leaf extractor segments in elongated grooves about its outer surface. The segments are prebent and biased in the assembly to displace extractor tips carried thereby radially outwardly. When the extractor assembly is fully seated within the revolver cylinder, cam surfaces on the cylinder maintain the extractor tips spaced radially inwardly of the cylinder chambers. Upon axial displacement of the extractor assembly, the extractor tips, under the natural bias of the segments, move radially outwardly into the grooves of the cartridge casings whereby the tips displace the casings rearwardly from the cylinder chambers. Upon spring return of the extractor assembly into the cylinder, the extractor tips are cammed radially inwardly and out of the chambers enabling the cylinder to be loaded.

22 Claims, 10 Drawing Figures

EXTRACTOR ASSEMBLY FOR RIMLESS CARTRIDGES

The present invention relates to hand guns of the revolver type and particularly relates to an extractor assembly for extracting rimless cartridges and casings from the revolver cylinder.

Revolvers are primarily designed for rimmed cartridges, that is, cartridges having rims larger in diameter than the diameter of the cartridge body. Cartridges of this type include the 38 Special, 357 Magnum, 22 Rimfire and 44 Magnum. Other cartridges, such as the 45 auto and 9mm auto used in automatic pistols, are rimless, that is, their heads are approximately the same diameter as their bodies. Rimless cartridges are usually selected for use in automatic pistols because of their improved magazine and feeding function. These rimless cartridges have, however, been adapted for use in revolvers, for example, by using half-moon clips. Half-moon clips combine two or three rimless cartridges in one assembly. The clip serves as a common rim on which the conventional revolver extractor mechanism operates. Half-moon clips enable fast loading of the cylinder and reliable ejection. However, half-moon clips require preloading and prevent firing and extracting single cartridges without also extracting the clip. Bent or distorted clips are also a potential source of malfunction. Further, half-moon clips of rimless cartridges preclude ready interchangeability of ammunition between automatic pistols and revolvers due to the different form of the ammunition needed for loading and handling.

Other types of revolver extractor assemblies for rimless cartridges have been proposed but each has various problems associated with its design. For example, U.S. Pat. No. 3,982,346 discloses a wire ring forming part of the extractor assembly for engaging and extracting rimless cartridges. However, the wire must be depressed as the individual cartridges are loaded into the revolver. This naturally impedes loading. Further, if a cartridge slips under the extractor ring, the gun is jammed and rendered useless since the extractor ring will not snap back over the cartridge head. Another extractor assembly for revolvers using rimless cartridges is disclosed in U.S. Pat. No. 1,181,417. This assembly requires an extractor which partially rotates to pick up the extractor grooves. As in the wire ring assembly, the cartridges must force the extractor out of the way to permit loading. Because the 9mm auto cartridge head is spaced off the front of the casing, the casing mouth has a relatively sharp shoulder. For the extractor to be forced aside, a lead-in chamfer is required on the extractor similar to the radius on the wire ring extractor. This same chamfer or radius works against extraction because this same surface must hook into the extractor groove and pull out the cartridges during extraction. U.S. Pat. No. 3,755,950 provides an extraction assembly including an extractor head having an array of semicircular notches engageable within the grooves of the cartridge casings. The notches are of necessity of smaller radius than the radii of the cylinder chambers. This requires that the cartridges be tilted upon partial insertion thereof into the chambers and also seated on the extractor head whereby the extractor head is utilized to insert the cartridges into the cylinder. Thus the extractor is unnecessarily an integral part of the loading operation.

Another problem associated with the ring and extractors noted above is that they can dampen the blow of the firing pin. For example, the cartridge casing length varies sufficiently from cartridge to cartridge to permit a cartridge to be held by the extractor without the casing mouth solidly engaging against the chamber shoulder. Due to the inherent spring characteristics of the extractor it tends to absorb energy when the cartridge is struck by the firing pin.

Accordingly, it is a primary object of the present invention to provide a novel and improved extractor assembly for rimless cartridges in a hand gun of the revolver type.

It is another object of the present invention to provide a novel and improved extractor assembly for rimless cartridges in a revolver which permits cartridges to be loaded into the revolver cylinder without engagement with, interference by, or resistance from any part of the extractor assembly.

It is still another object of the present invention to provide a novel and improved extractor assembly for rimless cartridges in a revolver having the extractor parts engageable with the cartridge casings for ejection purposes out of contact or engagement with the cartridge casings during firing.

It is a further object of the present invention to provide a novel and improved assembly for extracting rimless cartridges from the cylinder of a revolver which permits the extractor head to snap over any cartridge or which for any reason slips below or beneath the extractor head into the cylinder.

It is a still further object of the present invention to provide a novel and improved assembly for extracting rimless cartridges from the cylinder of a revolver which enables rapid assembly and disassembly of the extraction system components without special tooling.

It is a still further object of the present invention to provide a novel and improved assembly for extracting rimless cartridges from the cylinders of revolvers wherein the cartridge engaging extractors are relatively sharp permitting extraction of damaged or stuck casings.

It is a still further object of the present invention to provide a novel and improved assembly for extracting rimless cartridges from the cylinders of revolvers wherein the cartridge engaging extractor includes slender spring extractor segments which derive strength and durability from the complex cooperative support each segment receives from the cylinder yoke, extractor spring, extractor stem, extractor head, and collar.

It is a still further object of the present invention to provide a novel and improved assembly for extracting rimless cartridges from the cylinders of revolvers which permits use of the conventional half-moon rimless cartridge clips, if desired, or such clips in combination with single cartridges.

It is a further object of this invention to provide a novel and improved assembly for extracting rimless cartridges from the cylinders of revolvers which is designed to inhibit malfunction resulting from dirt or powder residues lodging within and interfering with proper extractor operation.

It is a further object of this invention to provide a novel and improved assembly for extracting rimless cartridges from the cylinders of revolvers in which cartridge engaging extractor segments cooperate with the extractor head member for limited movement of each segment radially of the cylinder, and for support of each segment during cartridge extraction.

It is a related object of the present invention to provide a novel and improved assembly for extracting rimless cartridges from the cylinders of revolvers which enables manufacture of a strong cylinder.

Additional objects and advantages of the invention will be set forth and imparted in the description which follows and in part will be obvious from the description, or may be learned by practice of the invention. The objects and advantages of the invention may be realized and obtained by means of the instrumentalities and combinations particularly pointed out in the appended claims.

To achieve the foregoing objects and advantages and in accordance with the present invention, as embodied and broadly described herein, the extractor assembly of the present invention, for use in a revolver having an annular array of cylindrical chambers in its cylinder, comprises an extractor rod carried concentrically within the cylinder for axial reciprocating movement relative thereto between first and second axial positions, a plurality of circumferentially spaced extractor segments carried by the extractor rod for reciprocating movement therewith and lying in substantial radial alignment with the respective cylinder chambers, each of the extractor segments having an extractor tip movable in a radially outward direction for engagement with the extractor groove of a cartridge casing disposed in the radially aligned chamber, means carried by the assembly for biasing each extractor tip for movement in the radially outward direction, and means for preventing radial outward movement of the extractor tips when the extractor rod lies in the first position and enabling radial outward movement of the extractor tips to engage the cartridge casings and extract them from the cylinder chambers in response to axial movement of the rod from the first position toward the second position.

Preferably, the extractor segments comprise elongated leaf springs having a radially outward bias. The spring leaf of the segments remote from their extractor tips captive within the cylinder to enable movement of the extractor tips in a radially outward direction under the bias of the spring leaf segments in response to movement of the extractor rod from the first position toward the second position. Also, it is preferred that the cylinder have a cam surface for displacing the extractor tips at the ends of the extractor segments in a radially inward direction in response to movement of the extractor rod after extraction toward the first position fully seated within the cylinder.

The foregoing objects, advantages, and characteristics of the present invention will become more apparent upon reference to the following specification, appended claims and drawings wherein:

Figure 1:
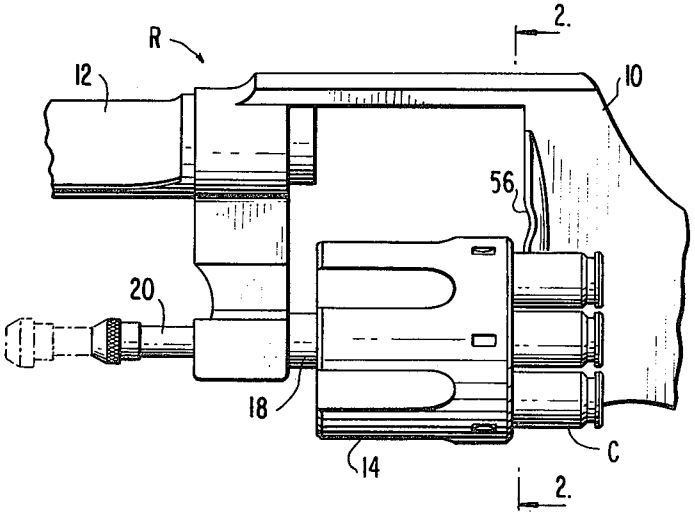
FIG. 1 is a fragmentary side elevational view of a hand gun or pistol of the revolver type with the chamber and extractor assembly of the present invention broken out of the frame for cartridge extraction and loading.

Referring now to the drawings, and particularly to FIG. 1, there is illustrated a hand gun or pistol of the revolver type generally designated R, comprised of a frame 10 mounting a barrel 12 and a cylinder 14, the latter cylinder 14 being broken out and disposed to one side of frame 10 into the conventional cartridge casing extraction and loading position. As is well known in revolver construction, cylinder 14 includes an annular array of cylindrical chambers or charge holes 16 for receiving cartridges C. Cylinder 14 is mounted on a yoke 18 pivotally secured to frame 10 and which yoke receives an elongated, axially movable extractor stem 20 for actuating the extractor assembly described in detail hereinafter.

Figures 3A, 3B:
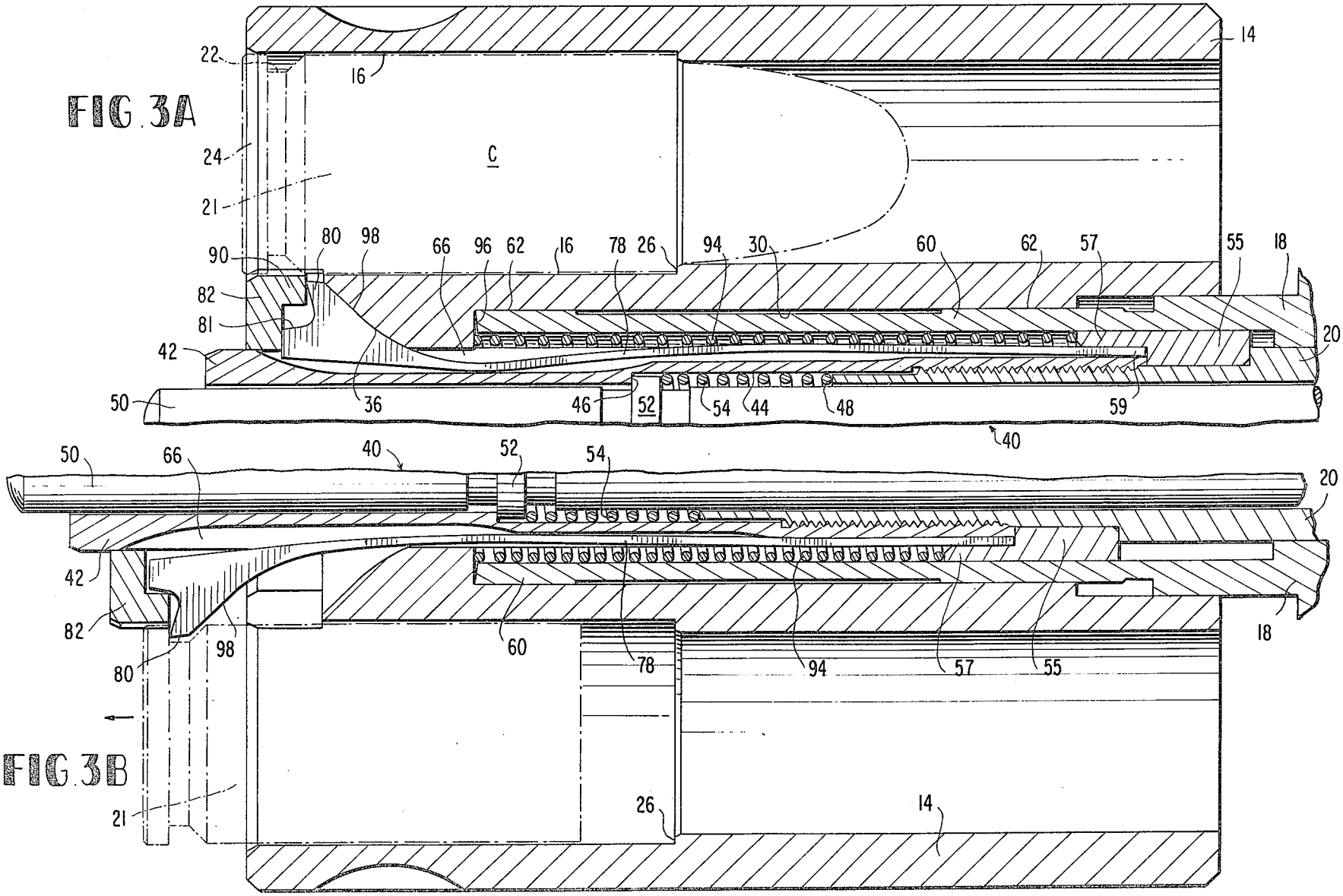
FIG. 3A is a fragmentary longitudinal sectional view of half the revolver cylinder illustrating the extractor assembly hereof in a fully seated position within the cylinder.
FIG. 3B is a view similar to FIG. 3A illustrating the extractor assembly in an intermediate position moving from its seated position toward a fully retracted position.

As will be recalled from the previous discussion, and referring particularly to FIGS. 3A and 3B, each cartridge includes a rimless cartridge casing 21 having the conventional grooved neck 22 and a flange or rim 24, flange 24 having a like diameter as the body of casing 21 and the charge hole 16. As is conventional, cartridges C are disposed in charge holes 16 with the forward edge of each cartridge casing butting the chamber shoulder 26.

Figure 5:
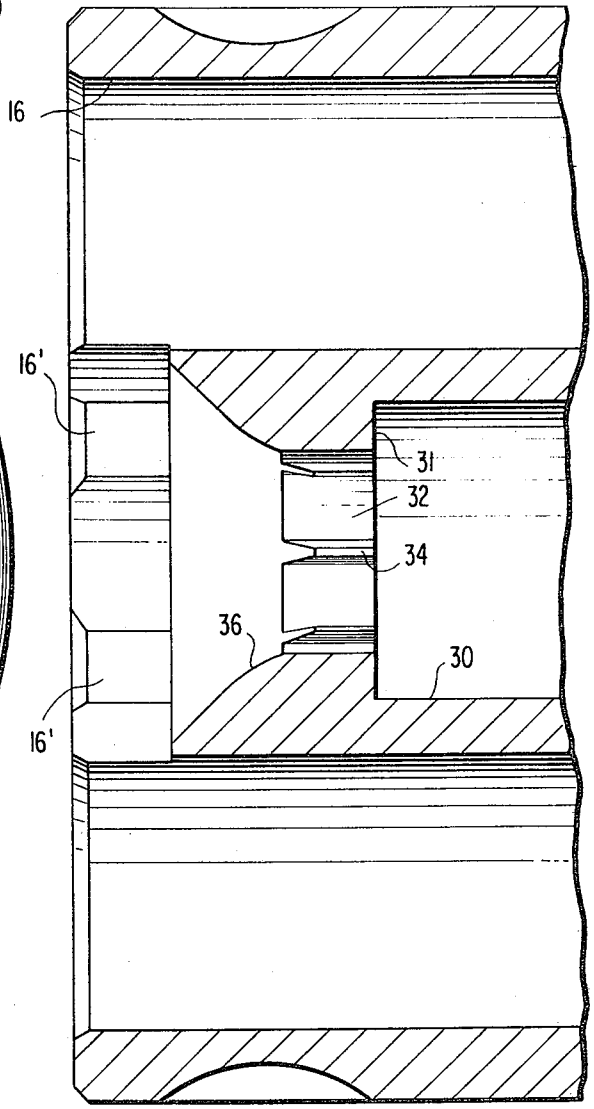
FIG. 5 is a fragmentary vertical sectional view through the centerline of the revolver cylinder with the extractor assembly removed.
Figure 4:
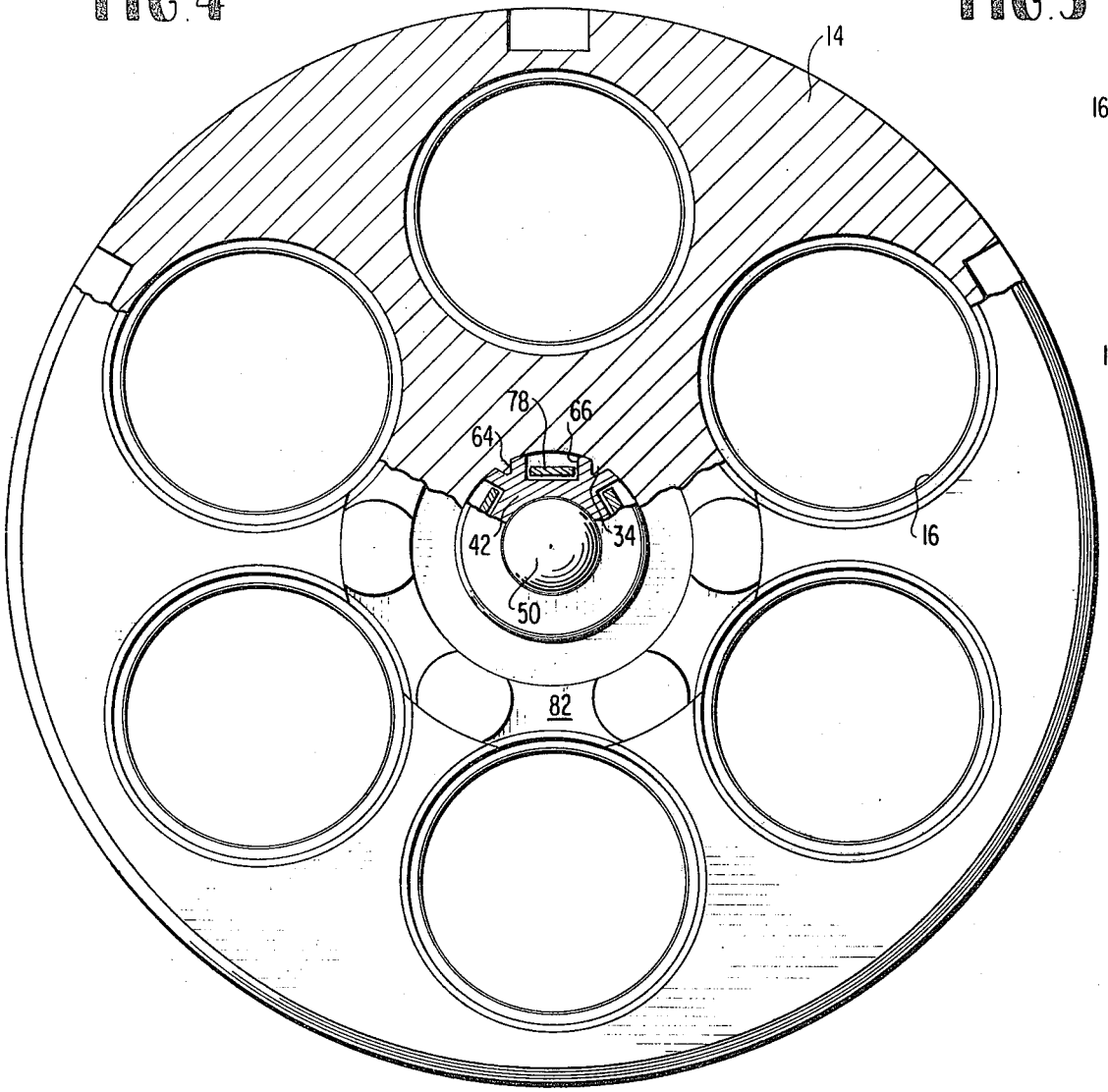
FIG. 4 is a rear end elevational view of the revolver cylinder with parts broken out and in cross section to illustrate the extractor segments and the cooperation between the extractor rod and cylinder.

Referring now to FIGS. 4 and 5, cylinder 14 includes a central bore 30 having adjacent its rear end a reduced diameter bore 32 separated from the central bore by a shoulder 31. For reasons discussed hereinafter, reduced diameter bore 32 has inwardly projecting splines 34 of a male spline. Bore 32 also flares radially outwardly in a rearward direction along a curved surface 36. For clarity in understanding drawing FIGS. 4 and 5, the charge holes or chambers 16 along the opposite side of the revolver cylinder are illustrated in part at 16'.

Referring back to FIGS. 3A and 3B, a retractor assembly constructed in accordance with the present invention is generally designated 40 and includes an extractor rod 42 which comprises an elongated sleeve, concentric with cylinder 14, terminating at its forward end in female threads threaded about male threads of the extractor stem 20. Extractor rod 42 has an enlarged diameter intermediate bore 44 defining a shoulder 46 spaced axially from the rearmost end and extractor stem 20. Extending through the bores of both extractor rod 42 and extractor stem 20 is a center pin 50 which has an enlarged annular flange 52 extending into enlarged bore 44. A center pin spring 54 engages between the end shoulder 48 of extractor stem 20 and the flange 52 of center pin 50 to normally maintain the latter in the position illustrated in FIG. 3A with its rearmost end projecting from the end of the revolver cylinder. The center pin is utilized to lock cylinder 14 in firing position in revolver frame 10 with the pin engaging in a recess, not shown, in the bolster face. Conventional mechanism, not shown, displaces pin 50 forwardly to permit the cylinder to be broken out of the revolver frame while a cam surface (FIG. 1) carried on the side of frame 10 enables the pin to be cammed forwardly against the bias of spring 54 when the cylinder is returned to its firing position within the gun frame.

Yoke 18 includes a rearwardly extending sleeve 60 having a pair of bearing surfaces 62 about which cylinder 14 rotates. Cylinder 14 is restrained from axial movement relative to yoke 18 by means not shown. Grooves 64 are provided substantially along the entire length of extractor rod 42 for receiving the splines 34 of cylinder 14 whereby extractor rod 42 is axially slidable relative to cylinder 14 but fixed for rotation therewith. An extractor rod collar 55 is disposed between the extractor rod 42 and a shoulder on extractor stem 20 when the rod and stem are threaded one to the other. Collar 55 has a rearwardly extending annular rim or lip 57 which defines an annular, axially and rearwardly opening, recess 59 with the outer surface of the forwardmost portion of extractor rod 42.

Circumferentially spaced about and extending substantially the entire length of extractor rod 42 are a plurality of grooves 66 (FIG. 4) best illustrated in FIG. 6 and, for reasons discussed hereinafter, each groove 66 is stepped. That is, each groove 66 has first, second and third stepped surfaces 68, 70 and 72 respectively which increase in depth along the outer surface of extractor rod 42 in a direction from its forward end to its rearmost end. Also, the rearmost and deepest stepped surface 72 has arcuate or flared surfaces 74 and 76 at its opposite ends. Each groove 66 receives an elongated extractor segment 78 in the form of an elongated leaf spring which terminates at one end in an outwardly projecting extractor tip 80. Each segment 78 has a stop 81 spaced radially inwardly from the tip 80 and which stop 81 projects slightly axially rearwardly of the tip 80. For reasons discussed hereinafter, each leaf spring segment 78 is prebent as illustrated in FIG. 6 before being located in the corresponding groove 66 in extractor rod 42.

Figure 6:
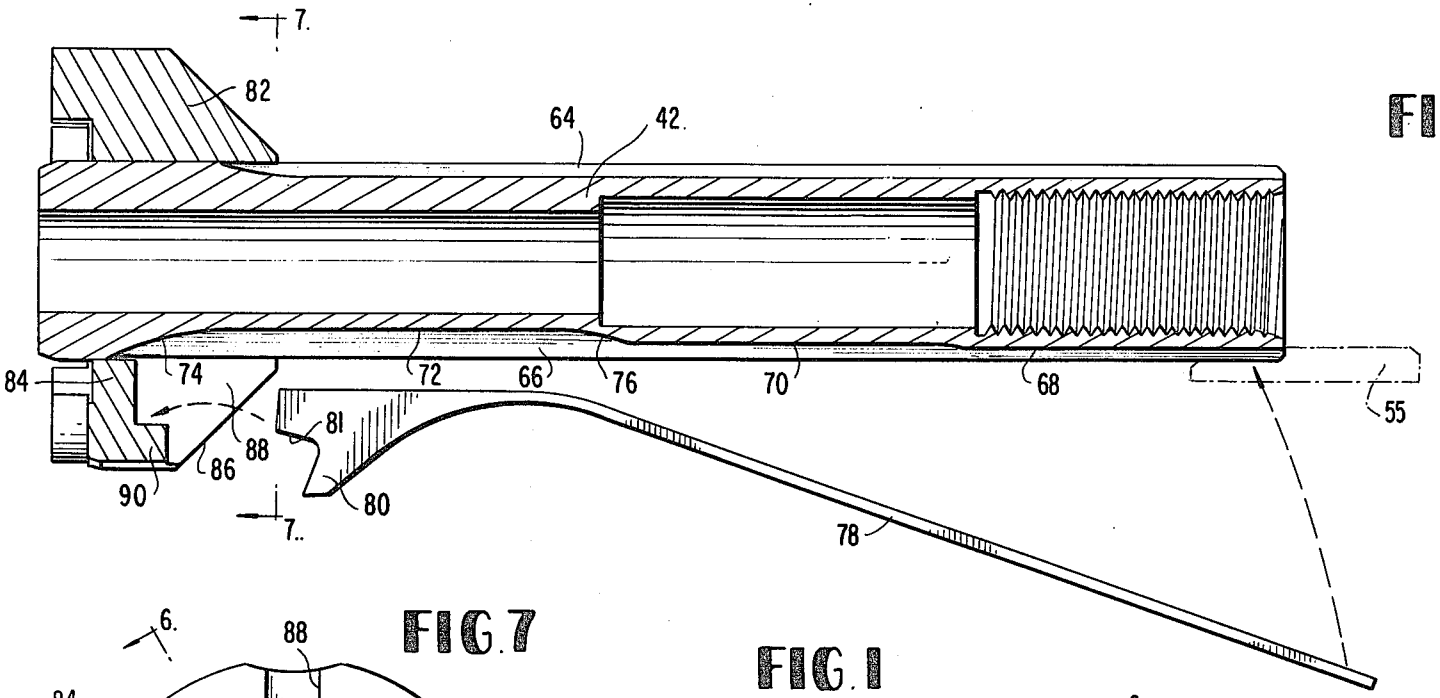
FIG. 6 is a longitudinal cross-sectional view of a portion of the extractor assembly with an extractor segment removed.
Figure 2:
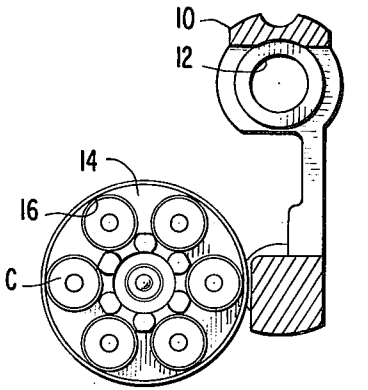
FIG. 2 is a cross-sectional view thereof taken generally about on line 2—2 in FIG. 1.
Figure 7:
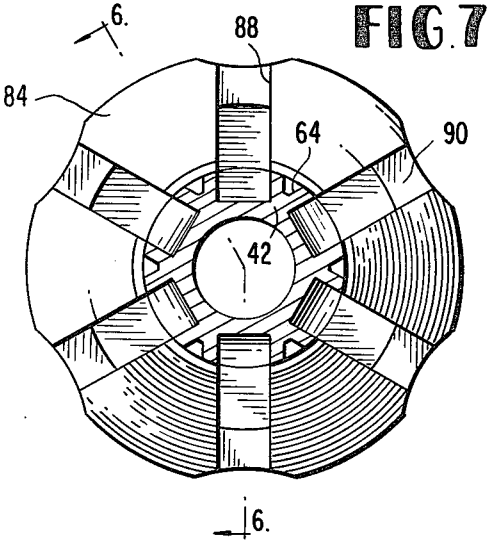
FIG. 7 is a cross-sectional view thereof taken generally about on line 7—7 in FIG. 6.

Referring now particularly to FIGS. 3A, 6 and 7, an extractor head 82 is suitably secured about the rearmost end of extractor rod 42. Head 82 comprises an annular member 84 which tapers in a forward direction, as indicated at 86 in FIG. 6, and has a plurality of circumferentially spaced, radially extending, slots 88 formed in its forward facing surface. The outer extremity of annular member 84 has discrete forwardly projecting flanges or lips 90 which overlie rearmost portions of the slots 88. When head 82 is disposed on extractor rod 42, the slots 88 are longitudinally aligned with and form continuations of the respective grooves 66 whereby the grooves 66 and slots 88 accomodate the full length of extractor segments 78.

When assembling extractor assembly 40, the forward ends of segments 78 are disposed in the recess 59 between the lip 57 of extractor rod collar 55 and the forward end of extractor rod 42. The remaining portion of each segment 78 is then bent against its natural bias and disposed within the corresponding groove 66 and slot 88 of the extractor head 82. Extractor tip 80 and stop 81 are thus disposed within slot 88 of extractor head 82 with stop 81 lying radially inwardly of flange 90 as best illustrated in FIG. 3A. When extractor rod 42 is disposed within yoke sleeve 60, an extractor spring 94 is engaged at one end against the axial face of lip 57 of extractor rod collar 55 and at its opposite end against shoulder 31 of cylinder 14. Consequently, extractor spring 94 encircles extractor rod 42 as well as the extractor segments 78 disposed in grooves 66.

When the extractor assembly is fully seated within cylinder 14 as illustrated in FIG. 3A, each extractor segment 78 is located within its groove 66 within coil spring 94 and its tip 80 and stop 81 lies within slots 88 of extractor head 82. Each extractor segment 78 also has an outer curved cam follower surface 98 which bears along the cam surface 36 formed adjacent the rearmost end of cylinder 14. It will be appreciated that, by prebending each extractor segment 78 to the configuration illustrated in FIG. 6, its natural bias, when held captive in the longitudinally extending groove 66 by coil spring 94 and rod 42, tends to displace tip 80 for radial outward movement. Tip 80 is, however, restrained from radial outward movement, when the extractor assembly is fully seated as illustrated in FIG. 3A, by cam surface 36 of cylinder 14. Consequently, each extractor tip 80 is spaced radially inwardly of the charge hole or chamber 16 and consequently also spaced from the cartridge in the chamber when the cylinder lies in firing position within gun frame 10. It will also be appreciated that, when the cylinder is in such firing position, cylinder 14 and extractor assembly 40 are rotatable about yoke 18 and yoke sleeve 60 by conventional mechanisms, not shown, operating against ratchet teeth provided on the rearmost end of extractor head 82.

When it is desired to extract cartridge casings 21 from cylinder 14, the cylinder is broken out of frame 10 in a conventional manner. Once broken out, the extractor assembly 40 is displaced in an axially rearward direction by manually rearwardly displacing the extractor stem 20. Stem 20 thus displaces extractor rod 42, center pin 50, extractor head 82, extractor segment 78 and extractor rod collar 57 rearwardly against the bias of extractor spring 94. It will be appreciated that when the extractor assembly is fully seated within cylinder 14, as illustrated in FIG. 3A, the extractor tip 80 of each segment 78 lies slightly forwardly of the groove 22 of the rimless cartridge C in the corresponding radially aligned chamber. Upon rearward axial displacement of extractor assembly 40, the natural bias of extractor segments 78 displaces extractor tips 80 radially outwardly into the grooves 22 of the cartridge casings. That is, the cam follower surfaces 98 are moved rearwardly relative to cam surfaces 36 thus enabling radially outward movement of tips 80. Extractor stops 81 butt the lips 90 on the extractor head to prevent further outward movement of the extractor tips 80 whereby the latter are prevented from jamming into the grooves 22 of the cartridge casings and/or jamming them against the walls of chamber 16. Extractor tips 80, however, engage the flanges 24 of the cartridge casings upon further displacement of the extractor assembly rearwardly and thus extract the cartridge casings from the chambers. The range of travel of the extractor assembly is preferably slightly greater than the length of the cartridge casings whereby the casings are pulled by the extractor segments clear of the cylinder and fall freely from the extractor assembly.

After the cartridge casings are extracted, extractor stem 20 is released whereupon extractor spring 94 displaces extracter assembly 40 forwardly into its position fully seated within cylinder 14 illustrated in FIG. 3A.

Upon such forward displacement, cam follower surfaces 98 of extractor segments 78 engage the cam surfaces 36 formed on the cylinder and cam the exterior tips 80 radially inwardly against the natural bias of the leaf spring segments 78. It will be appreciated that upon fully seating the extractor assembly, the extractor tips 80 are spaced from the chambers. The extraction assembly thus does not interfere in any way with loading.

It will be appreciated that the extractor segments are cooperatively supported within the yoke 18, sleeve 60, extractor spring 94, extractor head 82, collar 55 and the grooves 66 of extractor rod 42. These elements cooperate to protect the segments from damage and dirt intrusion. The slender portion of the segments operate in compression and collapse by buckling is prevented by support from the parts holding the segments captive. The larger portions of the extractor segments carrying the extractor tips and stops are restrained by the extractor head. This restraint coupled with the extraction force causes outward rotation or movement of the rearward ends of the segments. The segments then become supported by the rod and by the lips or stops 90 in the outer portion of the extractor head. The rearmost end is capable of withstanding these complex loads because of a generous radius 98 and enlarged cross section. The radius is also functional in that its shape determines the camming action required to extend and retract the segments. As previously noted, the grooves 66 of rod 42 contain the segments. The grooves vary in depth as illustrated by the stepped portions 68, 70 and 72 in FIG. 6 to permit the foregoing functional movements of the segments.

Figure 9:
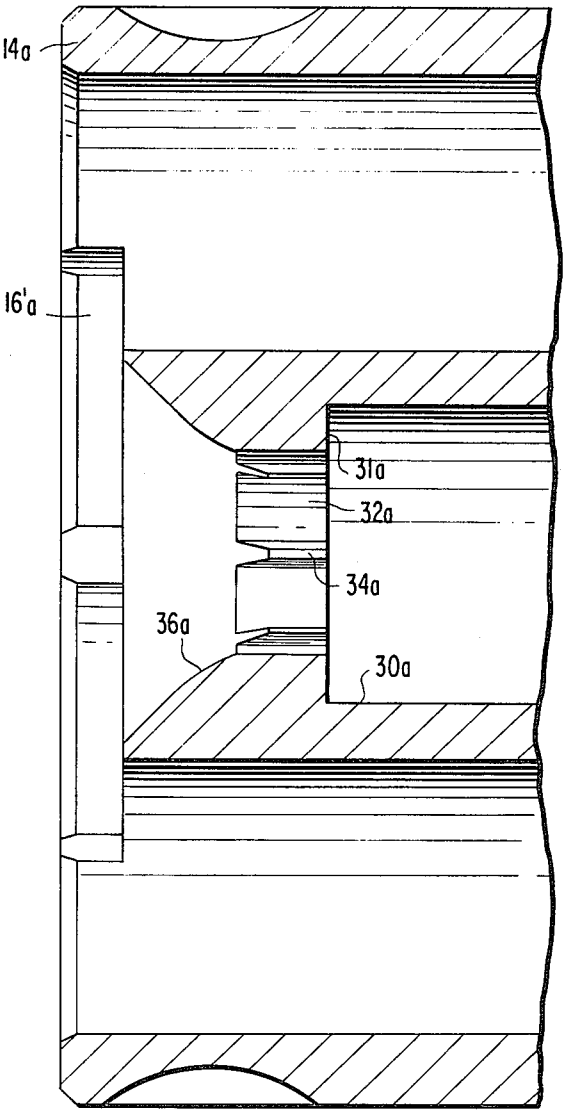
FIG. 9 is a view similar to FIG. 5 illustrating the rearmost end of revolver cylinder illustrated in FIG. 8.
Figure 8:
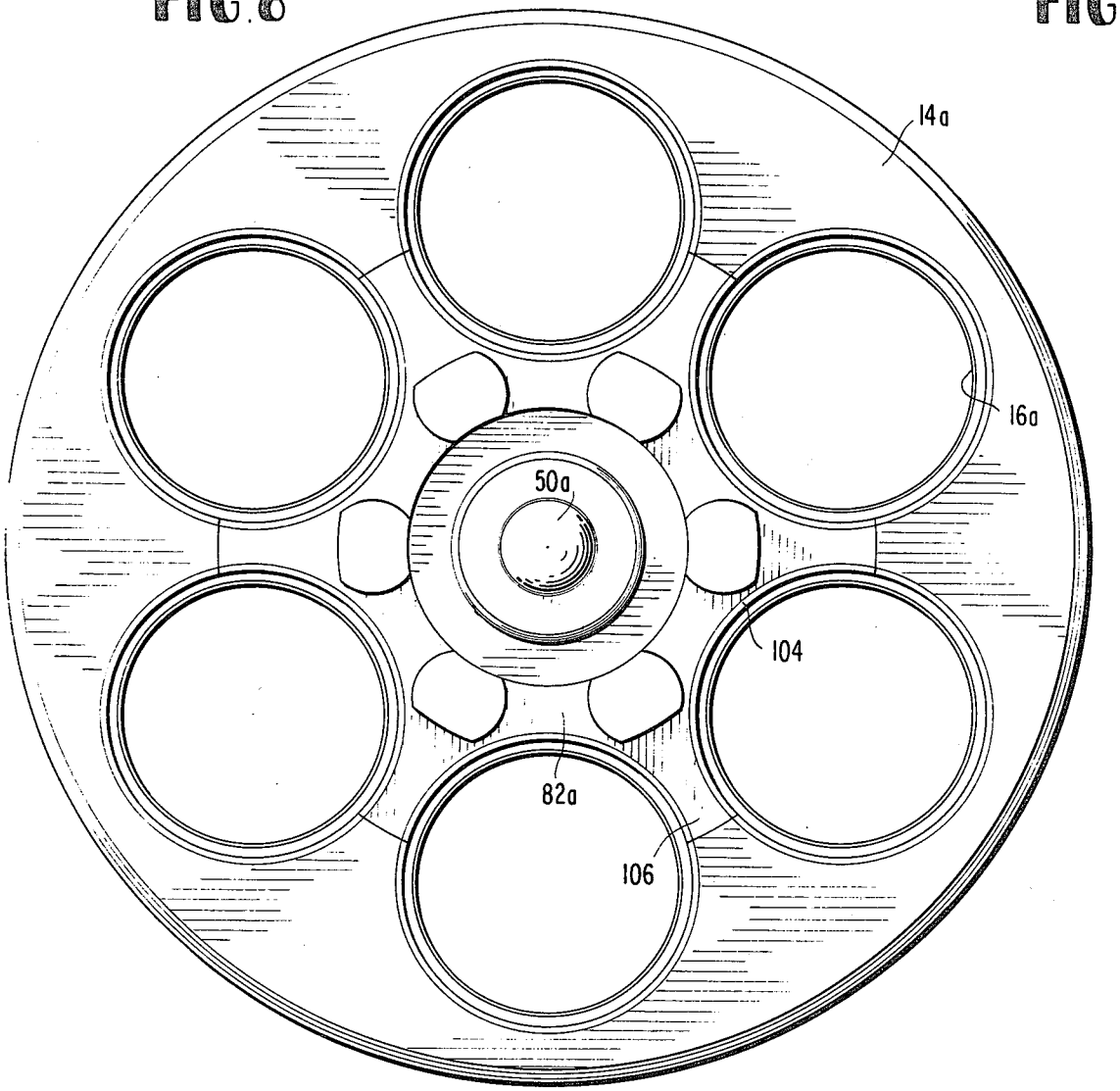
FIG. 8 is a rear end elevational view of a revolver cylinder illustrating a further form of extractor assembly hereof.

Referring now to FIGS. 8 and 9, there is illustrated a further embodiment of the present invention wherein like parts as in the previous embodiment are illustrated with like numerals followed by the suffix *a*. In this form, the head **82*a* is further radially extended in comparison with the head of the previous embodiment illustrated in FIG. 7. Particularly, head 82*a* includes an annular array of substantially semi-circular slots 104 formed about the periphery of the head in longitudinal alignment with the chambers 16*a* of cylinder 14*a*. The semi-circular slots 104 define horns 106 therebetween which project radially outwardly of the head. It will be observed that the horns cooperate with cartridges in the cylinder in minimizing relative rotation between the extractor and the cylinder body. The horns 106** also extend radially outwardly a sufficient distance to engage half-moon clips so that a revolver may be loaded with individual cartridges or half-moon clips. In fact, the cylinder will function with a combination of a half-moon clip and individual cartridges. In this regard the rear surface of the cylinder must be recessed to accomodate the space occupied by a half-moon clip.

An extractor assembly according to the present invention may be adjusted to solve a problem which may occur under combat conditions. Ordinarily, unfired rimless cartridges are free to fall from a cylinder after loading if the revolver is inverted (barrel pointed upward) during the loading operation and before closing the cylinder. This problem is overcome by permitting the extractor assembly to withdraw slightly from the cylinder so that the extractor segments move radially a small distance sufficient to engage the cartridge extraction grooves thereby preventing the unfired cartridges from freely falling out of the cylinder. This advantageous adjustment results from selecting an extractor spring 94 with insufficient spring force to drive the extractor assembly completely home as shown in FIG. 3A. It will be understood of course that this slight protrusion of each extractor segment will not interfere with the cartridge loading operation because each cartridge will ride over and depress each protruding extractor segment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore indended to be embraced therein.

What is claimed and desired to be secured by United States Letters Patent is:

1. A cartridge casing extractor assembly for use in a revolver having an annular array of cartridge receiving chambers in its cylinder comprising:

an extractor rod carried concentrically within the cylinder for axial reciprocating movement relative thereto between first and second axial positions, a plurality of circumferentially spaced extractor segments carried by said extractor rod for reciprocating movement therewith and lying in substantial radial alignment with the respective cylinder chambers, each said extractor segment having an extractor tip movable in a radially outward direction for engagement with the rim of a cartridge casing disposed in the radially aligned chamber, means carried by said assembly for biasing each said extractor tip for movement in said radially outward direction, means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position, and means carried by said rod for limiting the extent of radial outward movement of said extractor tips.

2. An assembly according to claim 1 wherein each said extractor segment comprises an elongated leaf spring having a radially outward bias, means including said extractor rod for holding a portion of said segment remote from said tip captive and enabling movement of said tip in a radially outward direction under the bias of said spring leaf segment and in response to movement of said rod from said first position toward said second position.

3. An assembly according to claim 1 including means for displacing said extractor tips in a radially inward direction in response to movement of said extractor rod toward said first position.

4. An assembly according to claim 1 wherein each said extractor segment comprises an elongated leaf spring having forward and rearmost end portions with an intermediate portion therebetween, said tip being located adjacent said rearmost end portion of said spring and projecting radially outwardly thereof, said spring being prebent in said intermediate portion thereof such that the forward and rearmost end portions form an obtuse angle with said tip lying on the same side of said segment as the formed obtuse angle, each said segment in assembly being disposed substantially longitudinally whereby said rearmost segment end and tip carried thereby are naturally biased in a radially outward direction.

5. A cartridge casing extractor assembly for use in a revolver having an annular array of cartridge receiving chambers in its cylinder comprising:

an extractor rod carried concentrically within the cylinder for axial reciprocating movement relative thereto between first and second axial positions, said extractor rod having a plurality of circumferentially spaced longitudinally spaced grooves formed about its outer surface, a plurality of extractor segments, each extractor segment comprising an elongated leaf spring having radially outward bias and being located in an extractor rod groove for reciprocating movement with the extractor rod and lying in substantial radial alignment with the respective cylinder chambers, each said extractor segment having an extractor tip movable in a radially outward direction for engagement with the rim of a cartridge casing disposed in the radially aligned chamber, means including said extractor rod for holding a portion of said segment remote from said tip captive and enabling movement of said tip in a radially outward direction under the bias of said spring leaf segment and in response to movement of said rod from said first position toward said second position, and means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position.

6. An assembly according to claim 5 including means carried by said extractor rod and engageable with the cylinder enabling axial movement of said rod relative to the cylinder and preventing relative rotation between said rod and the cylinder.

7. A cartridge casing extractor assembly for use in a revolver having an annular array of cartridge receiving chambers in its cylinder comprising:

an extractor rod carried concentrically within the cylinder for axial reciprocating movement relative thereto between first and secondd axial positions, a plurality of circumferentially spaced extractor segments comprising elongated leaf springs having radially outward bias carried by said extractor rod for reciprocating movement with the extractor rod and lying in substantial radial alignment with the respective cylinder chambers, each said extractor segment having an extractor tip movable in a radially outward direction for engagement with the rim of a cartridge casing disposed in the radially aligned chamber, means including said extractor rod for holding a portion of said segment remote from said tip captive and enabling movement of said tip in a radially outward direction under the bias of said spring leaf segment and in response to movement of said rod from said first position toward said second position, means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position, and an extractor rod collar adjacent the forward end of said extractor rod for holding the forward end of each of said leaf spring segments captive about said rod.

8. An assembly according to claim 7 including means disposed between said collar and the cylinder biasing said extractor rod for movement in a direction toward said first position.

9. A cartridge casing extractor assembly for use in a revolver having an annular array of cartridge receiving chambers in its cylinder comprising:

an extractor rod carried concentrically within the cylinder for axial reciprocating movement relative thereto between first and second axial positions, a plurality of circumferentially spaced extractor segments carried by said extractor rod for reciprocating movement therewith and lying in substantial radial alignment with the respective cylinder chambers, each said extractor segment having an extractor tip movable in a radially outward direction for engagement with the rim of a cartridge casing disposed in the radially aligned chamber, means carried by said assembly for biasing each said extractor tip for movement in said radially outward direction, means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position, and an extractor head carried by said extractor rod for axial movement therewith, said head having a plurality of circumferentially spaced slots for receiving portions of said extractor segments.

10. A cartridge casing extractor assembly for use in a revolver having an annular array of cartridge receiving chambers in its cylinder comprising:

an extractor rod carried concentrically within the cylinder for axial reciprocating movement relative thereto between first and second axial positions, a plurality of circumferentially spaced, longitudinally extending grooves formed about the outer surface of the extractor rod, a plurality of circumferentially spaced extractor segments comprising leaf springs having radially outward bias carried by said extractor rod grooves for reciprocating movement therewith and lying in substantial radial alignment with the respective cylinder chambers, each said extractor segment having an extractor tip movable in a radially outward direction for engagement with the rim of a cartridge casing disposed in the radially aligned chamber, means including said extractor rod for holding a portion of said segment remote from said tip captive and enabling movement of said tip in a radially outward direction under the bias of said spring leaf segment and in response to movement of said rod from said first position toward said second position, means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position, and means carried by said extractor rod and engageable with the cylinder enabling axial movement of said rod relative to the cylinder and preventing relative rotation between said rod and the cylinder, an extractor rod collar adjacent the forward end of said extractor rod for holding the forward end of each of said leaf spring segments captive about said rod, means disposed between said collar and the cylinder biasing said extractor rod for movement in a direction toward said first position, an extractor head carried by said extractor rod for axial movement therewith, said head having a plurality of circumferentially spaced slots for receiving portions of said extractor segments, and means carried by said head in said slots for limiting the extent of radial outward movement of said extractor tips.

11. A cartridge casing extractor assembly for use in a revolver having an annular array of cartridge receiving chambers in its cylinder comprising:

an extractor rod carried concentrically within the cylinder for axial reciprocating movement relative thereto between first and second axial positions, a plurality of circumferentially spaced, longitudinally extending, grooves formed about the outer surface of the extractor rod, a plurality of circumferentially spaced extractor segments comprising leaf springs having radially outward bias carried by said extractor rod grooves for reciprocating movement therewith and lying in substantial radial alignment with the respective cylinder chambers, each said extractor segment having an extractor tip movable in a radially outward direction for engagement with the rim of a cartridge casing disposed in the radially aligned chamber, means including said extractor rod for holding a portion of said segment remote from said tip captive and enabling movement of said tip in a radially outward direction under the bias of said spring leaf segment and in response to movement of said rod from said first position toward said second position, means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position, and an extractor head carried by said extractor rod for axial movement therewith, said head having a plurality of circumferentially spaced slots for receiving portions of said extractor segments, said slots lying in respective longitudinal registry with said grooves.

12. An assembly according to claim 11 including means for displacing said extractor tips in a radially inward direction in response to movement of said extractor rod toward said first position.

13. An assembly according to claim 11 wherein said extractor head carries stops disposed in said slots at locations spaced radially outwardly of said rod, said segments having surfaces engageable with said stops for limiting the extent of radial outward movement of said extractor tips.

14. A revolver comprising:

a revolver frame, a cylinder carried by said frame and having an annular array of cartridge receiving chambers; and an extractor assembly carried by said cylinder including an extractor rod carried concentrically within said cylinder for axial reciprocating movement relative thereto between first and second axial positions, a plurality of circumferentially spaced extractor segments carried by said extractor rod for reciprocating movement therewith and lying in substantial radial alignment with the respective cylinder chambers, each said extractor segment having an extractor tip movable in a radially outward direction for engagement with the rim of a cartridge casing disposed in the radially aligned chamber, means carried by said assembly for biasing each said extractor tip for movement in said radially outward direction, means for preventing radial outward movement of said extractor tips when said extractor rod lies in said first position and enabling radial outward movement of said extractor tips to engage the cartridge casings and extract them from said cylinder chambers in response to axial movement of said rod from said first position toward said second position, and said extractor rod having a plurality of circumferentially spaced, longitudinally extending grooves formed about its outer surface for receiving said extactor segments.

15. A revolver according to claim 14 wherein each said extractor segment comprises an elongated leaf spring having a radially outward bias, means including said extractor rod for holding a portion of said segment remote from said tip captive and enabling movement of said tip in a radially outward direction under the bias of said spring leaf segment and in response to movement of said rod from said first position toward said second position.

16. A revolver according to claim 15 which includes means carried by said extractor rod and engageable with said cylinder enabling axial movement of said rod relative to said cylinder and preventing relative rotation between said rod and said cylinder.

17. A revolver according to claim 16 including means carried by said assembly for biasing said extractor rod for movement in a direction toward said first position.

18. A revolver according to claim 14 including means carried by said cylinder for displacing said extractor tips in a radially inward direction in response to movement of said extractor rod toward said first position and into said cylinder.

19. A revolver according to claim 14 wherein said cylinder has a recess in its rearmost face, an extractor head carried by said extractor rod for axial movement therewith and for movement into said recess when said rod lies in said first position, each said extractor segment comprising an elongated leaf spring having a radially outward bias, means including said extractor rod for holding a portion of said segment remote from said tip captive and enabling movement of said tip in a radially outward direction under the bias of said spring leaf segment and in response to movement of said rod from said first position toward said second position, said head having a plurality of circumferentially spaced slots in respective longitudinal registry with said grooves for receiving portions of said extractor segments.

20. A revolver according to claim 19 including means carried by said head for limiting the extent of radial outward movement of said extractor tips.

21. A cartridge casing extractor assembly for use in a revolver having an annular array of cartridge receiving chambers in its cylinder comprising:

an extractor rod carried concentrically within the cylinder for axial reciprocating movement relative thereto between first and second axial positions, means for biasing the extractor rod toward the first axial position, a plurality of circumferentially spaced extractor segments carried by said extractor rod for reciprocating movement therewith and lying in substantial radial alignment with the respective cylinder chambers, each said extractor segment having an extractor tip movable in a radially outward direction for engagement with the rim of a cartridge casing disposed in the radially aligned chamber, means carried by said assembly for biasing each said extractor tip for movement in said radially outward direction, means for preventing radial outward movement of said extractor tips when said extractor rod lies in said first position and enabling radial outward movement of said extractor tips to engage the cartridge casings and extract them from the cylinder chambers in response to axial movement of said rod from said first position toward said second position, and said extractor rod biasing means for supporting each extractor segment during cartridge extraction.

22. An assembly as defined in claim 21 which further includes means for circumferentially supporting the extractor rod biasing means.

* * * * *